United States Patent [19]

Sano et al.

[11] Patent Number: 4,514,112

[45] Date of Patent: Apr. 30, 1985

[54] METHOD FOR INJECTING GROUTING AGENT AND APPARATUS FOR CONDUCTING THE METHOD

[75] Inventors: Sakae Sano; Hisashi Kitajima, both of Tokyo; Hiroshi Iimori, Yokohama; Tadashi Nishio, Koganei, all of Japan

[73] Assignees: Toa Grout Kogyo Co., Ltd.; Mitsui Toatsu Chemicals, Inc.; Tonan Kaihatsu/Kogyo Co., Ltd., all of Tokyo, Japan

[21] Appl. No.: 598,648

[22] Filed: Apr. 10, 1984

[30] Foreign Application Priority Data

Apr. 19, 1983 [JP] Japan ..... 58-67786

[51] Int. Cl.[3] ..... E02D 3/12

[52] U.S. Cl. ..... 405/269; 405/266

[58] Field of Search ..... 405/233, 258, 263, 266, 405/267, 269

[56] References Cited

U.S. PATENT DOCUMENTS

| | | | |
|---|---|---|---|
| 4,302,132 | 11/1981 | Ogawa et al. | 405/269 |
| 4,309,129 | 1/1982 | Takahashi | 405/269 |

FOREIGN PATENT DOCUMENTS

| | | | |
|---|---|---|---|
| 108519 | 8/1980 | Japan | 405/269 |
| 165315 | 12/1980 | Japan | 405/269 |
| 41917 | 4/1981 | Japan | 405/269 |

*Primary Examiner*—David H. Corbin

*Attorney, Agent, or Firm*—Jordan and Hamburg

[57] ABSTRACT

A method for improving the ground or foundation by injecting a grouting agent from the tip end of a hollow injection rod inserted into a boring hole formed in the ground at site so as to infiltrate it into the ground to be solidified. The injection is carried out by varying an injection pressure or injection rate depending on the intensity, particularly, the tensile strength, of the ground so that no vein-like coagulation can be formed around the injection rod, and a columnar or spherical coagulation can be formed.

6 Claims, 5 Drawing Figures

METHOD FOR INJECTING GROUTING AGENT AND APPARATUS FOR CONDUCTING THE METHOD

BACKGROUND OF THE INVENTION

1. Field of the Invention

This invention relates to a method for improving the ground to intensify subterranean loose ground or prevent water permeability in a water-permeable stratum, and also to an apparatus for carrying out the method.

2. Description of the Prior Art

In order to prevent spring water occurrence or water leakage in the ground comprising clayey soil, sandy soil or sands and pebbles or to prevent rupture of soil or intensify soils, it has been so far usually practised to inject a grouting agent in the ground through a hollow injection rod such as a boring rod, a strainer pipe, a double pipe, etc. to be solidified. It is not always satisfactory for stably and uniformly improving the ground depending on the soil stratum conditions such as the intensity, water-permeability, etc. of the ground. In other words, it is not always satisfactory for forming a columnar or spherical coagulation with a uniform diameter, for the following reasons.

When the grouting agent is injected according to the conventional methods, the ground is often ruptured in weak region. Once the ground is ruptured, the grouting agent flows along the ruptured surfaces, and consequently the formed coagulation presents irregular cross-sectional shapes. The rupture of ground has been so far presumed to take place, because the infiltration pressure due to the injection of the grouting agent becomes too high relative to the shearing strength of the concerned region. In other words, according to the conventionally accepted theory, the cause for failure to form a uniform coagulation is an occurrence of a hydraulic fracturing phenomenon in the ground due to that a high infiltration pressure is brought about by the injection, which results in forming shear planes in the ground and occurring infiltration of the grouting agent along these planes, so that the vein-like, irregular coagulation is formed. Thus, it is the conventional expedient to inject the grouting agent under a constant pressure so that the infiltration pressure may not exceed the shearing strength of ground. In order to obtain a thorough infiltration up to the desired region, it takes a long time with an economical dissatisfaction.

As a result of extensive studies, the present inventors have found that the conventionally accepted theory is not correct and the hydraulic fracturing phenomenon of the ground appears to be caused mainly by a tensile stress developed in the ground by the injection of the grouting agent, which is excess of the tensile strength of the ground. When the grouting agent is injected under some pressure through the hollow injection rod, the tensile stress rapidly decreases with increasing distance from the center of the hollow injection rod in the radial direction and rapidly increases towards the center to the contrary. That is, in a diagram having a tensile stress on the ordinate and a distance from the center of the hollow injection rod on the abscissa, the tensile stress can be plotted in a concave curve running from the left upside to the right downside (see FIG. 1). According to this finding, it can be assured that the grouting agent must be injected at an injection rate as low as possible in the initial period of injection, and after the infiltration has been made to the region near the center where the excessive tensile stress is liable to form, the injection rate may be increased continuously (see FIG. 2, curve a) or stepwise (see FIG. 2, curve b) in contrast to said curve of tensile stress. This assumption has been proved to be correct through many tests.

When the grouting agent for stabilizing the ground is injected through the hollow injection rod inserted in the ground according to the well known method, the grouting agent is generally gushed or leaked upwards along the periphery of the injection rod, and consequently it is very difficult to form coagulation in the desired region. That is, prevention of water permeability, or intensification or improvement of the ground cannot be thoroughly attained.

In order to solve the problem that the grouting agent gushes or leaks out, a chemical packer has been proposed, which is a gelation product formed by forcedly injecting a flash setting chemical solution between the periphery of the hollow injection rod and the bore wall. However, the strength of the gelation product is too low to withstand the injection pressure of the grouting agent, and the gelation product is liable to be ruptured and loopholes are liable to develop so that the packer effect will be lost and that the grouting agent will gush or leak out through the loopholes of the packer.

Also proposed are a sleeve injection method comprising steps of providing an outer pipe in a bore hole after a casing boring has been made with a rotary boring machine or a rotary percussion boring machine, filling sealing agent into the clearance between the outer pipe and the bore wall, setting a double packer in the outer pipe at a position corresponding to depths of the ground destined to the injection, then supplying a grouting agent under pressure into a space formed by the packer elements through an inner pipe arranged in the outer pipe, making the grouting agent gushing out the space through small holes formed in the outer pipe, rupturing the sealing agent by the gushing grouting agent and injecting the grouting agent through the resulting cracks, a method utilizing a mechanical packer such as a rubber ring arranged to be pressed on the both sides by a screw means so that a portion thereof is circumferentially protruded beyond the outer surface of the rod or such as an air packer inflatable by compressed air so as to seal the clearance between the periphery of the hollow injection rod and the boring wall. However, these methods need the casing boring in order to set the packer and thus complicate the injection operation, and the maintenance of boring wall is difficult, so that the function of mechanical packer or air packer is deteriorated. That is, no satisfactory packer effect can be obtained.

In a rod injection method using a hollow injection rod, the grouting agent is liable to leak through voids around the hollow injection rod or along the boundary surfaces of coarse grain layers in an unconsolidated ground such as alluvium. In order to prevent grouting agent from leaking out of the injection region, a method for injecting a flash setting grouting agent through a double pipe rod has been proposed, but owing to the short gelation time, the injection of the grouting agent into the ground leads to a vein-like split infiltration, so that the infiltration into the soil grains becomes incomplete.

An injection method using a strainer pipe is not preferable, because the strainer pipe is left in the ground after the injection has been made, and also it is troublesome to insert the strainer pipe in the ground. Also proposed in a composite injection method comprising steps of forming at first the flash setting chemical packer around the double pipe rod above the portion destined for the injection and then infiltrating a long gel-time grouting agent into soil grains. However the strength of the resulting packer is low because of the chemical packer, as described above.

SUMMARY OF THE INVENTION

The present invention has been made in order to solve these problems and is to provide a method capable of stably and uniformly injecting the grouting agent into the ground having complicated structure and properties and thus capable of uniformly improving the intensity or water cutoff ability of the ground, and also an apparatus for carrying out the method.

According to the first step of the method in accordance with present invention, the grouting agent is injected under a controlled injection pressure by keeping a discharge rate of the grouting agent at a low value, thereby keeping a tensile stress to be developed in the ground by the injection of the grouting agent lower than the tensile strength of the ground until some initial infiltration region is formed around the hollow injection rod.

According to the second step of the method, the grouting agent is injected under a controlled injection pressure by changing the discharge rate of the grouting agent continuously or stepwise, after the formation of said initial infiltration region, by keeping a tensile stress to be developed by further injection outside the said initial infiltration region lower than the tensile strength of the ground in the region of further injection.

The tensile strength of the ground can be indirectly detected by, for example, a lateral load test in a bore hole. According to the lateral load test in the bore hole, boring is made with a hollow injection rod, then compressed air or liquid is supplied to an inflatable packer element attached to the tip end of the hollow injection rod so that the inflated packer element is tightly contacted to the boring wall, then an air or liquid pressure applied on the packer element is stepwise increased by means of a pressure gauge, and the strength of soil is determined from a change in the amount of the compressed fluid with time and the applied pressure value.

How to control the injection pressure according to the obtained values of tensile strength (and circumferentially, of water permeability coefficient of the ground) at conducting the injection can be determined in advance experimentally with using a test ground. Otherwise the injection pressure can be obtained by an appropriate formula.

According to a preferable embodiment of the present invention, the grouting agent is injected with keeping the viscosity of the injecting agent low and substantially constant until some initial infiltration is made in a center region having a radius smaller than the desired infiltration radius. This is because, when the grouting agent having a high viscosity is injected, hardening proceeds during the injection, and thus the infiltration pressure must be considerably increased.

The present invention is further characterized by an end member having a packer and at least two discharge outlets for the grouting agent, the end member being provided at the lower end of an inner tube of the rod so as to be pulled into an outer tube when the rod is thrusted into the ground and exposed from the outer tube when the forward end of the rod reaches a position desired to the injection, the packer being actuated when the end member is exposed, and then the grouting agent is introduced into the inner tube and gushed out through said discharge outlets.

The present invention is further characterized in that, after the protrusion of said end member by the pressurized fluid, the inflation pressure in the packer is adjusted in accordance with the injection pressure and the bore wall state by a pressure converter, that the supply of the grouting agent is adjusted by a supply-rate adjusting means which converts a difference between a preset supply rate and an indicated supply rate to a signal, so as to develop a tensile stress by the initial injection lower than the tensile strength of the ground, that, after the initial injection has been completed, the supply of the grouting agent is adjusted by said supply-rate adjusting means so as to inject the grouting agent at a continuously or stepwise increased discharge rate, and that a hardening time of the grouting agent is adjusted by transmitting the signal of said supply-rate adjusting means to automatic discharge control valves.

By successively and rapidly changing the discharge rate of the grouting agent depending on the condition of the ground destined to the injection, the grouting agent can be stably and uniformly injected into the ground having complicated structure and properties.

Mechanism of the injection method according to the present invention for changing the discharge rate of the grouting agent with a remarkable injection effect is given below:

When changes in the injection pressure of the grouting agent in the ground, as discharged from the hollow grouting agent injection rod are investigated in a pressure reduction ration around the hollow injection rod, generally the pressure reduction ratio is not large in a central circular region having a radius of about 20 cm from the center of the hollow injection rod, though it depends on the soil quality, relative density (for example, N value), void ratio, water content, presence of underground water, etc. in the ground, and the pressure reduction ratio is extremely increased with radially going apart from the said central circular region.

That is, the pressure reduction ratio is not large at a position relatively near the hollow injection rod when the grouting agent is injected, and the injection pressure gives a load directly to the ground. In order to uniformly infiltrate the grouting agent without rupturing the ground, the grouting agent must be injected at such a low discharge rate as to produce a lower injection pressure than the resistance pressure of the ground. On the other hand, the pressure reduction ratio is large in the ground outside the said central circular region near the hollow injection rod, and the ground is hardly susceptible to the influence of the outlet pressure of the grouting agent at the discharge outlet. Thus, even if the grouting agent is injected at a higher discharge rate (pressure), the injection pressure becomes lower than the resistance pressure in the ground destined to the further injection, and the grouting agent can be thoroughly and uniformly infiltrated into the ground without rupturing it.

The present method can attain the injection effect only by changing the discharge rate of the grouting agent, and more uniform infiltration of the grouting agent into the ground can be attained with using a packer according to the present invention.

The grouting agents for use in the present invention include a combination of cement slurry and water glass, a combination of water glass and acid substance with an additive such as inorganic acid salts of alkaline earth metals and trivalent metal salts, and a combination of water glass and bicarbonate of alkali with an additive such as inorganic acid salts of alkaline earth metals, trivalent metal salts, or organic substances decomposible in an alkali region to produce an acid substance.

THE BRIEF DESCRIPTION OF THE DRAWINGS

The above and other objects as well as various advantages of the invention will be more clearly appreciated by studying the following detailed explanation to be made in reference to the accompanying drawings, in which.

DESCRIPTION OF THE PREFERRED EMBODIMENTS

Figure 1:
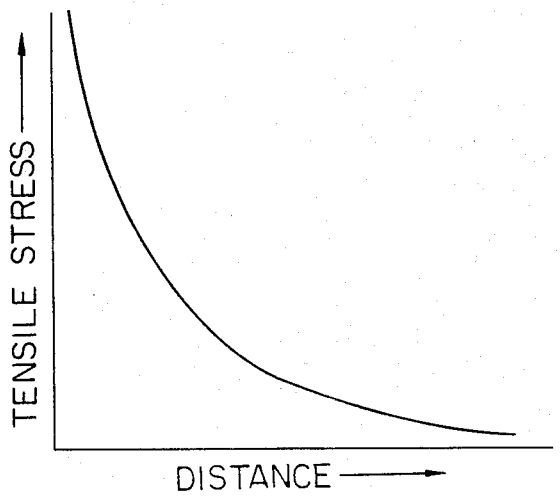
FIG. 1 is a graph showing a tensile stress to be developed in a ground by a grouting agent discharged from a hollow injection rod with respect to a radial distance from the hollow injection rod.
Figure 2:
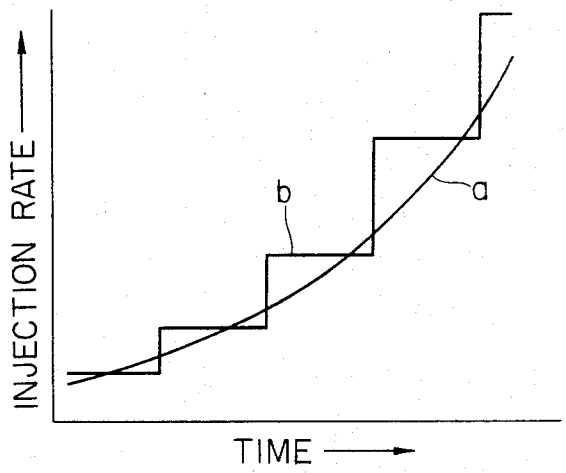
FIG. 2 is a graph showing injection at varied discharge rates according to the present invention.
Figure 3:
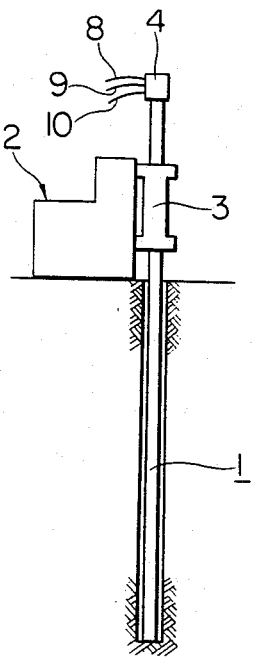
FIG. 3 is a schematic view showing a state of boring down to a desired depth by the boring-injection rod.
Figure 4:
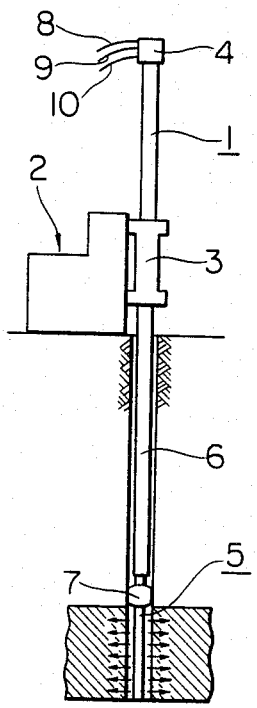
FIG. 4 is a schematic view showing a state of injecting the grouting agent while a protrusible end member is exposed.

FIGS. 3 and 4 show processes of boring and successive injection of the grouting agent with the present apparatus, where numeral 1 is a duplex boring-injection hollow rod, 2 a boring machine, 3 a device of rotating or vertically moving the boring-injection rod, and 4 is a swivel for introducing a boring water, a pressurized fluid, the grouting agent, etc. into the device, the swivel being fixed at the upper end of the boring-injection rod.

In boring work shown in FIG. 3, the rod 1 is rotated and given a pushdown force by the boring machine 2, and the boring water is supplied into the rod 1 through the swivel 4 and gushed from the lower end of the rod. At the lower end of the rod, bits for scraping the soil is provided (not shown in the drawings). The scraped soil is mixed with the boring water to make slime, and some of the slime is infiltrated into the ground, while the other is sent back to the ground surface along the outer periphery of the rod 1. After boring has been effected to a predermined depth, only an outer tube 6 of the rod 1 is pulled up over a predetermined range to expose a protrusible end member 5 connected at the lower end of an inner tube of the rod 1 (not shown in the drawings), or the entire rod is slightly pulled up, and then the protrusible end member 5 is pushed out of the outer tube 6, as shown in FIG. 4. Then, a packer sleeve 7 mounted on the protrusible end member 5 is inflated by a pressurizing fluid supplied into the spaced formed between the inner and outer tubes of the rod 1, and then the grouting agent is supplied through the swivel 4 into the inner tube and gushed from fluid discharge openings formed in the periphery of the protrusible end member 5, as shown by arrows, to be injected into the ground.

Figure 5:
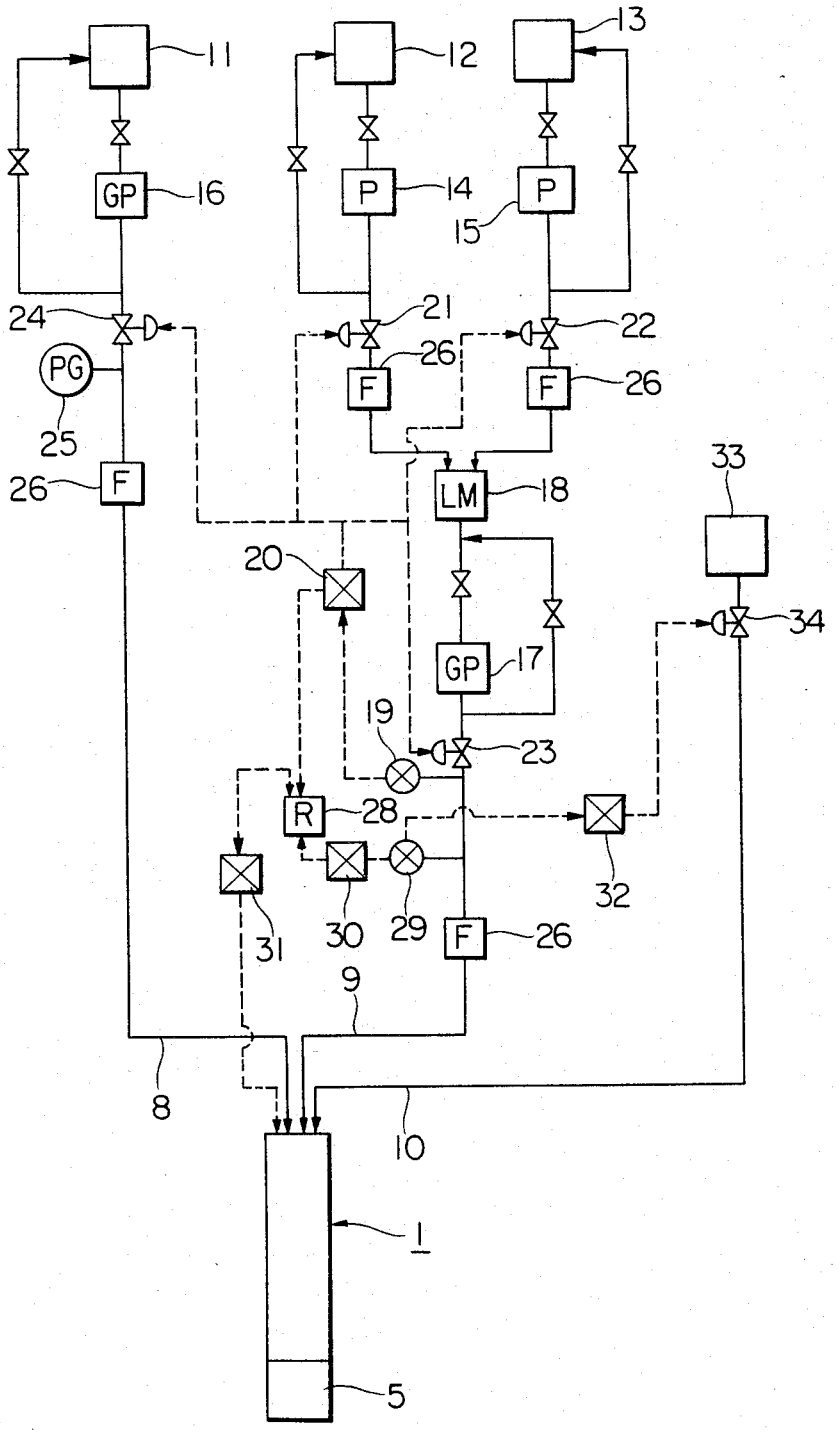
FIG. 5 is a diagram showing an apparatus according to the present invention.

FIG. 5 shows an apparatus for supplying the grouting agent into the hollow rod 1 under a controlled pressure and for supplying the pressurizing fluid for pushing the end member 5 out of the rod 1 and inflating the packer 7, where pipes 8, 9 and 10 are connected to the swivel 4 shown in FIGS. 3 and 4.

In FIG. 5, 11 is a tank for a main grouting agent liquid, 12 is that for a hardening agent liquid, and 13 is that for an additive liquid such as a hardening-promoting agent liquid or water; 14 and 15 are liquid supply pumps; 16 and 17 injection pumps; 18 a line mixer; 19 a flow rate detecting means for converting a supply liquid flow rate to a signal; 20 an indicator for controlling automatic discharge control valves 21, 22, 23 and 24 belonging to the liquid supply pumps 14 and 15 and injection pumps 16 and 17 respectively, depending on the signal applied from the flow rate detecting means 19 (the flow rate detecting means 19 and the indicator 20 together are called "an injection flow rate-controlling means"); 25 a pressure gauge; 26 flow rate meters. As the line mixer 18, for example, a shot mixer, a brush mixer, an ejector, a static mixer, etc. can be used, and a recorder 28 is connected to the indicator 20. The recorder 28 has a mechanism for summing up the quantity of injected materials. 30 is an indicator for delivering an instruction signal upon receipt of a signal from an injection pressure-detecting means 29. 31 is an indicator for delivering an instruction signal upon receipt of a signal as to a predetermined injection amount per step as summed up in the recorder 28, 32 an indicator for delivering an instruction signal to an automatic discharge control valve 34 belonging to a pressurizing fluid tank 33 upon receipt of a signal from the injection pressure-detecting means 29 to adjust the inflation pressure of an inflatable packer 7 fixed to the end member 5. The protrusion pressure for the end member 5 is usually above 1 kg/cm$^2$, and the inflation pressure of the packer is set in accordance with the injection pressure of the grouting agent and the boring wall state. In FIG. 5, dotted lines indicate signal lines.

The hardening agent liquid is supplied by the liquid supply pump 14, the additive liquid such as a hardening-promoter liquid or water is supplied by the liquid supply pump 15 and they are mixed in the line mixer 18. The resulting mixture is supplied under pressure by the injection pump 17 to the hollow injection rod 1, mixed with the main grouting agent liquid supplied under pressure by the injection pump 16 and injected into the ground through discharging outlets formed at the end member 5.

In the indicator means 20, a preset discharge rate (injection rate) of the grouting agent depending on the tensile strength, water permeability coefficient, etc. of the ground at the site is memorized, and the discharge valves 23 and 24 are controlled in accordance with the preset value to adjust the discharge rate (i.e. discharge pressure) of the grouting agent through the hollow injection rod 1. Furthermore, in the indicator means 20, a desired injection amount for a first step and also desired injection amounts for the individual successive steps are memorized. When the flow rate detecting means 19 confirm that the desired injection amount has been injected for each step and transmits a signal to the indicator means 20, the indicator means 20 controls the valves 21, 22 and 24 to change a mixing ratio of the grouting agent and set the viscosity and hardening time of the grouting agent for the successive step.

The injection pressure detecting means 29 monitors the pressure of the grouting agent supplied to the hollow injection rod 1, and delivers a signal to the indicator 32 in accordance with the gauged pressure. The indicator 32 controls the valve 34 to adjust the inflation pressure of a packer.

The injection amount in the individual steps are transmitted from the indicator means 20 to the recorder 28 and recorded and summed up therein. When the summed-up value reaches the desired injection amount at a given injection depth, a zero pressure signal is transmitted from the injection pressure detecting means 29 through the indicator 30 to the indicator 31 which transmits an instruction signal for stepping up the hollow injection rod 1 to the boring machine 2. Then, the similar injection steps as described above are repeated.

In the present invention, the curing time of the grouting agent for the initial injection and for the secondary and successive injections is usually set to 30 seconds or more to avoid vein-like and split injection. That is, if the hardening time is set to, for example, less than 30 seconds, the hardening of the grouting agent takes place in the vicinity of the hollow injection rod, and the successive injection proceeds through the gel of hardened grouting agent. That is, the successive injection can be carried out only under an injection pressure in excess of the injection resistance by the gel, and thus the injection pressure becomes larger than the resistance of the ground, and uniform infiltration and injection to the ground becomes difficult.

EXAMPLE

In a concrete artificial pit, 350 cm wide, 600 cm long and 300 cm high, a stamped test ground of sand soil having a water permeability coefficient of $1.12\times 10^{-2}$ cm/sec, a porosity of 42% and a water content of 13% was formed. With a double pipe rod consisting of the outer tube, 45 mm in outer diameter having boring bits at the lower end thereof and the inner tube, 20 mm in outer diameter, having the end member 5 at the lower end thereof, the test ground was bored. The end member 5 is provided with a 100 mm-long rubber packer and discharge outlets for the grouting agent with an opening diameter of 5 mm, a set of four discharge outlets being formed on a same level at an angle of 45° along the periphery and four sets of discharge outlets are arranged one below another with leaving a distance of 20 mm to one another. Each set of discharge outlets is covered with an elastic ring fitted on the periphery of the end member 5. In order to form a columnar coagulation having an injection improvement diameter of 0.8 m in an injection improvement depth range of GL (Ground Level) −2.75 to −0.5 m, boring was made with the double pipe rod at first until the end of the rod reached GL −2.75 m, where the end member 5 was protruded from the outer tube 6 under a protrusion pressure of 4 kg/cm$^2$, and then the packer 7 of the end member 5 was inflated with the pressurized air supplied by a compressor 33 under a pressure of 4.5 kg/cm$^2$.

Then, a water glass-based grouting agent (MG Rock No. 1, a product made by Mitsui Toatsu Chemicals, Inc., Japan) was initially injected through the discharge outlets at a discharge rate of 2 l/min. for 5 minutes while setting the hardening time of the grouting agent to 6 minutes, and successively at a discharge rate of 8 l/min. for 4 minutes, and further at a discharge rate of 16 l/min. for 4 minutes with the same curing time, with a total of 106 l at the same level. After the injection of 106 l for one step, the application of pressure to the packer was discontinued to shrink the packer, and then the double pipe rod was pulled up step for step each by 50 cm by means of the automatic pulling machine 3, and the similar injecting operations was carried out at the individual level. The positions for inflating the packer were at 4 levels of GL −2.0 m, −1.5 m, −1.0 m and −0.4 m to effect 4 step injections.

After the injection was completed, the test ground was disintegrated to investigate the injection state of the grouting agent. It was found that the grouting agent was uniformly injected in a columnar state having a diameter of about 80 cm around the injection rod in the depth range of GL −2.75 to −0.5 m. Particularly, even when the grouting agent was injected at a shallow position from the ground surface, such as GL −0.5 m, no gushing of the grouting agent was observed. The actual injection pressure was 1.0 to 2.5 kg/cm$^2$ over the entire injection time.

Then injection was carried out in the same test ground as above with the double pipe rod with no end member under the same injection conditions as above as to the injection step levels, hardening time of grouting agent, changes in the discharge rate, and injection amount for each step. After the injection was completed, the test ground was disintegrated to invenstigate the injection state of the grouting agent. It was found that the grouting agent was gushed along the injection rod and substantially no solidified soil was observed in a depth range of GL −2.75 to −1.0 m, and that an irregular coagulation with no columnar uniform infiltration was formed in a depth range GL −1.0 to −0.3 m.

We claim:

1. A method for injecting a grouting agent comprising a first step of injecting a grouting agent under a controlled injection pressure by setting a discharge rate to a low value, thereby keeping a tensile stress to be developed in the ground by the injection of the grouting agent lower than the tensile strength of the ground, and forming an initial injection region where the grouting agent is uniformly infiltrated in the vicinity of an injection rod among a desired region destined to the injection by the grouting agent in the ground, and a second step of further injecting the grouting agent under a controlled injection pressure by continuously or stepwise increasing the discharge rate of the grouting agent, thereby keeping a tensile stress to be developed by the further injection of the grouting agent in the ground lower than the tensile strength in the ground outside the initial injection region, and forming an injection region where the grouting agent is further uniformly infiltrated outside the initial injection region.

2. A method according to claim 1, wherein the grouting agent is injected while keeping the viscosity of the grouting agent substantially constant until the grouting agent infiltrates to a desired radius from the injection rod, and then the grouting agent is injected while changing mixing ratio of a main grouting agent, a hardening agent and an additive until the grouting agent further reaches a longer desired radius destined to the injection.

3. A method according to claim 1, wherein as the injection rod a double injection rod having an outer tube and an inner tube is used, said inner tube being connected with an end member having an elastic packer inflatable by a pressurized fluid and discharge outlets communicating with the inner tube, said end member being encased into the outer tube when boring is carried out with the injection rod, and protruded from the outer tube prior to the injection of the grouting agent, characterized in that the pressurized fluid is introduced into the packer just after the end member is protruded from the outer tube, and the inner pressure of the packer is changed in accordance with the injection pressure of the grouting agent.

4. An apparatus for carrying out a method for injecting a grouting agent with using a packer, said method comprising a first step of injecting a grouting agent under a controlled injection pressure by setting a discharge rate to a low value, thereby keeping a tensile stress to be developed in the ground by the injection of the grouting agent lower than the tensile strength of the ground, and forming an initial injection region where the grouting agent is uniformly infiltrated in the vicinity of an injection rod among a desired region destined to the injection by the grouting agent in the ground, and a second step of further injecting the grouting agent under a controlled injection pressure by continuously or stepwise increasing the discharge rate of the grouting agent, thereby keeping a tensile stress to be developed by the further injection of the grouting agent in the ground lower than the tensile strength in the ground outside the initial injection region, and forming an injection region where the grouting agent is further uniformly infiltrated outside the initial injection region, said apparatus comprising a means for forwardly driving the injection rod into the ground, a means for bringing the packer into a workable state, tank means for the grouting agent, pump means for supplying the grouting agent from the tank means, a discharge rate-adjusting means for continuously or stepwise adjusting the discharge rate of the grouting agent from the pumps in response to a given signal, an injection pressure detecting means, provided at the downstream of the discharge rate-adjusting means, for detecting the injection pressure of the grouting agent to the injection rod, thereby emitting a signal depending on the detected pressure and adjusting an inflation pressure applied to the packer, a flow rate-detecting means, provided at the downstream of the discharge rate-adjusting means, for detecting the flow rate of the grouting agent to the injection rod, thereby emitting a signal corresponding to a detected flow rate, and an indicator means for memorizing a desired injection amount and a preset discharge rate of the grouting agent for each injection position of the rod and emitting a signal to the discharge rate-adjusting means upon receipt of the signal given from the flow rate-detecting means when an amount of injection conducted according to the preset discharge rate reaches the desired injection amount, thereby instructing an injection of the second step.

5. An apparatus according to claim 4, wherein the tank means comprises a first tank for main grouting agent, a second tank for hardening agent and a third tank for an additive, the pump means comprises the first, second and third pumps for the first, second and third tanks respectively, and a fourth pump for discharging a mixture of the hardening agent and the additive, the discharge rate-adjusting means comprises the first, second, third and fourth discharge rate control valves provided correspondingly at the downstreams of the first, second, third and fourth pumps, the fourth pump receives the mixture through the line mixer connected to the second and third discharge rate control valves and supplies it to the injection rod, the injection pressure-detecting means is connected to at least one of downstreams of the first and fourth discharge rate control valves, the flow rate-detecting means is connected to at least one of downstreams of the first and fourth discharge rate control valves, and the indicator means memorizes a preset injection amount necessary for the infiltration of the grouting agent into the ground over the desired radius around the injection rod and emits a signal when the necessary amount of injection is accomplished, thereby continuously and rapidly changing the mixing ratio of the three components of the grouting agent.

6. An apparatus according to claim 4, wherein the packer is a mechanical packer inflatable by a pressurizing fluid, provided on the end member together with two or more discharge outlets for the grouting agent, the end member is provided at the tip end of the inner tube of the injection rod, the automatic control valve of the tank for the pressurizing fluid is opened prior to the injection of the grouting agent, thereby protruding the end member from the outer tube by the pressurizing fluid from the tank and inflating the packer, and the injection pressure-detecting means detects the injection pressure and emits a signal corresponding to a detected pressure, thereby adjusting the automatic control valve so as to inflate and shrink the packer in accordance with an injection pressure of the grouting agent.

* * * * *